United States Patent [19]

Hayes

[11] Patent Number: 4,774,972

[45] Date of Patent: Oct. 4, 1988

[54] VENTILATED TOBACCO SMOKE FILTER

[75] Inventor: Ernest B. Hayes, Leighton Buzzard, England

[73] Assignee: Cigarette Components Limited, London, England

[21] Appl. No.: 846,158

[22] Filed: Mar. 31, 1986

[30] Foreign Application Priority Data

Apr. 22, 1985 [GB] United Kingdom ..... 8510179
Oct. 22, 1985 [GB] United Kingdom ..... 8525966

[51] Int. Cl.[4] ..... A24D 3/04

[52] U.S. Cl. ..... 131/336; 131/341; 131/344

[58] Field of Search ..... 131/336, 341, 344

[56] References Cited

U.S. PATENT DOCUMENTS

| | | | |
|---|---|---|---|
| 3,410,275 | 11/1968 | Tucker | 131/336 |
| 4,232,574 | 11/1980 | Hall | 131/336 |
| 4,406,295 | 9/1983 | Sanford et al. | 131/336 |
| 4,600,027 | 7/1986 | Houck et al. | 131/336 |

FOREIGN PATENT DOCUMENTS

| | | | |
|---|---|---|---|
| 0913486 | 10/1972 | Canada | 131/336 |
| 0059042 | 9/1982 | European Pat. Off. . | |
| 864247 | 3/1962 | United Kingdom . | |
| 961362 | 6/1964 | United Kingdom . | |
| 2090117 | 7/1982 | United Kingdom . | |

*Primary Examiner*—V. Millin
*Attorney, Agent, or Firm*—Fleit, Jacobson, Cohn & Price

[57] ABSTRACT

A tobacco smoke filter having a non-integral core of components [2, 3] joined and held in longitudinal alignment by a strip [1] which extends only partially around the core circumference to leave a gap [7] extending longitudinally of the core between the longitudinal edges [8] of the strip, and an outer wrap [5] which engages fully around the core and strip and provides—e.g. via perforations [9]—for the lateral ingress of external ventilating air therethrough and through the longitudinal gap.

9 Claims, 4 Drawing Sheets

VENTILATED TOBACCO SMOKE FILTER

This invention relates to tobacco smoke filters and in particular to ventilated such filters. It is applicable with particular advantage, but by no means exclusively, to filters having a non-integral core of longitudinally aligned components; providing ventilation for such filters has long posed a problem, the various filter structures previously proposed for achieving this each having one or more draw-backs on the grounds of cost, product performance or consistency, manufacturing convenience, etc; the present invention affords a neat and effective solution to this particular problem, but is applicable also to filters with longitudinally integral cores.

The invention provides a tobacco smoke filter having an elongate core, one or more strips each extending along and only partially around the core circumference to leave a gap or gaps extending longitudinally of the core between longitudinal strip edges, and an outer wrap which engages fully around the core and one or more strips and provides for the lateral ingress of external ventilating air therethrough and through a said longitudinal gap. The invention also provides a tobacco smoke filter rod of finite length having an elongate core and one or more strips each extending along and only partially around the core circumference to leave a gap or gaps extending longitudinally of the core between longitudinal strip edges and through which the core is exposed to the ambient air.

In one preferred aspect of the invention provides a tobacco smoke filter having a non-integral core of components joined and held in longitudinal alignment by plugwrap which extends only partially around the core circumference to leave a gap extending longitudinally of the core between the longitudinal edges of the plugwrap, and an outer wrap which engages fully around the core and plugwrap and provides for the lateral ingress of external ventilating air therethrough and through the longitudinal gap; it also provides a tobacco smoke filter rod of finite length having a non-integral core of components joined and held in longitudinal alignment by plugwrap which extends only partially around the core circumference to leave a gap which extends longitudinally of the core between the longitudinal edges of the plugwrap and through which the core is exposed to the ambient air.

The one or more strips may be air-permeable or -impermeable; the one or more strips may for example be of conventional plugwrap paper or plastics film or foil or woven or non-woven fabric etc. Where a single strip is employed, it may for example extend around from 40 to 50% of the core circumference, though wider and narrower partial plugwraps are possible. Where two or more strips are employed they will be circumferentially spaced and may for example be of such widths as to leave 50%, 60%, 70% or even 80% of the core circumference uncovered. Multiple strips may be fine, e.g. in the form of circumferentially spaced threads, strings, or fine rods etc. The filter with its ventilating outer wrap is preferably be self-supporting; more preferably, the assembly of core and strip[s] or threads etc. is self-supporting and handleable without the ventilating outer wrap. The or each strip will normally extend parallel to the core axis, but in other cases may extend in helical conformation along and around the core. The strip[s] may be secured to the core by way of a heat seal adhesive coating thereon, or by other adhesive [e.g. conventional plugwrap adhesive] which could be applied at the time of manufacture. At least the longitudinal edges of the or each strip should be adhered to the core.

The core may be a unitary body, e.g. a porous rod of bonded cellulose acetate tow; the invention is however particularly applicable to the case of a non-integral core of longitudinally aligned components, these components being joined and held in longitudinal alignment by the strip[s].

There is no restriction as to the core components which can be used, provided that the required ventilation is achievable in the filter product. Thus core components can be filtering or non-filtering; core components which are tubular and/or externally profiled [e.g. grooved] and of filtering or non-filtering material, may be used. Longitudinally adjacent core components may be the same or different; where they differ they may do so in any one or more of numerous respects—e.g. length, pressure drop, filtering efficiency, composition, cross-sectional shape, etc., etc. Longitudinally adjacent core components may abut, or at least some may be longitudinally spaced. Where there is ventilation through the outer wrap directly into a cavity adjacent to a core component, thorough mixing of air and smoke can occur in the cavity, and this can result in an even end staining of the filter when smoked, eliminating the "halo" effect normally encountered with conventional ventilated filters; this even distribution of smoke at the buccal end of the filter can also reduce or eliminate the softening by hot smoke of the centre of the buccal end of the filter frequently encountered with conventional ventilated filters.

The ventilating outer wrap may be a tipping overwrap by which the filter is incorporated in a filter cigarette. The ventilating outer wrap may be of inherently air-permeable material; ventilation, however, is preferably at least mainly via perforations in the outer wrap which are in register with the longitudinal gaps between the longitudinal strip edges—ventilating perforations may be provided, for example, circumferentially around the outer wrap. Where there is a space between longitudinally adjacent core components and the outer wrap has ventilating perforations, the latter are preferably in register with this space.

Individual core components, e.g. filter plugs, may themselves be unwrapped or wrapped with permeable or impermeable material, provided that the required ventilation is achievable in the filter product.

The or each strip is conveniently of durable material so that it and hence the composite filter rod can be handle easily on high speed commerical production machinery. The strip material can be air-permeable. The composite rod of core components and strip[s] or threads etc. as initially produced, optionally wrapped in an air-permeable wrap, will normally be of an even multiple, e.g. 2, 4 or 6, of the length of the eventual individual filter units. For filter cigarette manufacture, a double length filter rod can in conventional manner be abutted between a pair of tobacco rods, joined thereto by a tipping overwrap [the ventilating outer wrap of the filter according to the invention], and the resulting composite cut centrally into two filter cigarettes. Where the filter according to the invention is provided with its own permeable outer wrap, it can instead be incorporated in a filter cigarette by ring tipping.

The invention is illustrated, by way of example only, by the following description of specific embodiments, to be taken in conjunction with the accompanying drawings in which like reference numerals denote like parts and in which.

Figure 1:
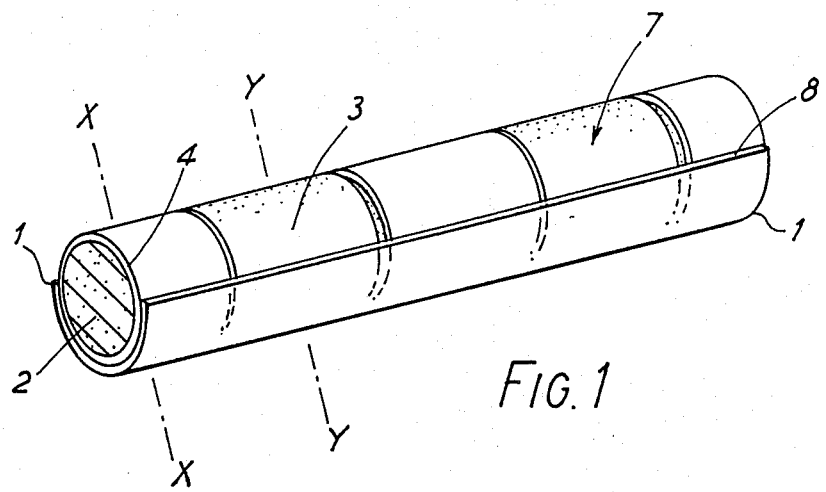
FIGS. 1,4,7 and 10 are perspective views of four different finite length tobacco smoke filter rods according to the invention.
Figure 2:
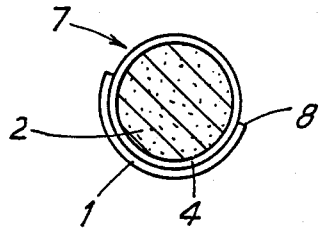
FIGS. 2 and 3 are cross-sectional on lines X—X and Y—Y respectively through the FIG. 1 rod.
Figure 3:
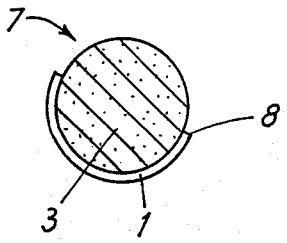
Figure 7:
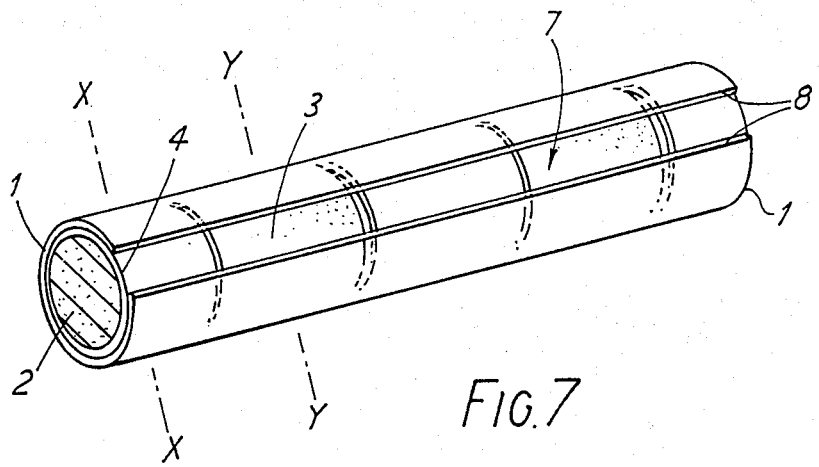
Figure 8:
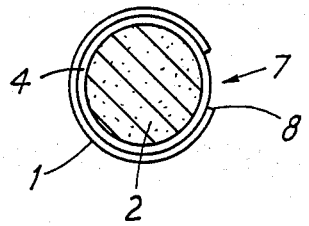
FIGS. 8 and 9 are cross-sectional on lines X—X and Y—Y respectively through the FIG. 7 rod.
Figure 9:
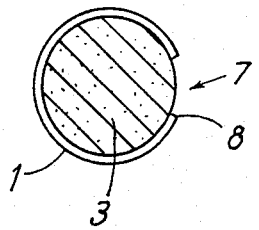

In the embodiment of FIGS. 1–3, and in that of FIGS. 7–9, a tobacco smoke filter rod has a non-integral core of components 2, 3 joined and held in longitudinal alignment by a strip or partial plugwrap 1. A gap 7 extends longitudinally of the core between the longitudinal edges 8 of the plugwrap 1.

In the FIG. 1 and FIG. 7 embodiments adjacent core components 2, 3 abut; component 2 is a filter segment wrapped in a non-porous plugwrap 4 whereas component 3 is a non-wrapped filter segment.

The partial plugwrap 1 is adhered to the core components 2, 3 at least at the longitudinal edges 8.

Figure 4:
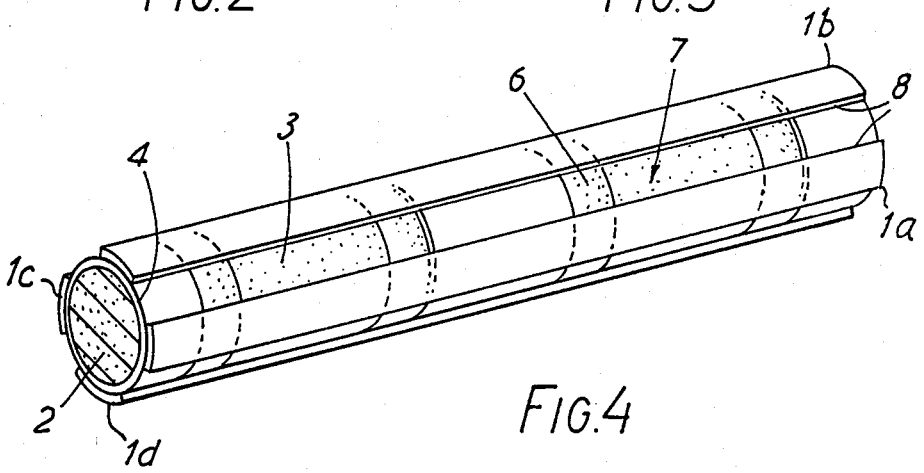

FIG. 4 shows another tobacco smoke filter rod with adjacent core components 2, 3 longitudinally spaced apart. A cavity 6 is defined between opposed ends of adjacent components 2, 3 and the inner surface of four strips or partial plugwraps 1*a*, 1*b*, 1*c*, and 1*d*; the cavity has an opening provided by gaps 7 between the strip edges 8.

Figure 10:
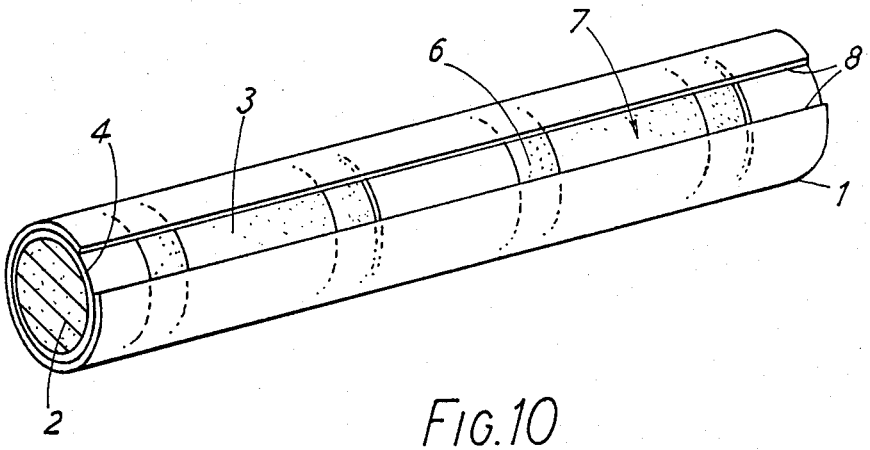

FIG. 10 shows another tobacco smoke filter rod with adjacent core components 2,3 longitudinally spaced apart. A cavity 6 is defined between opposed ends of adjacent componts 2,3 and the inner surface of the partial plugwrap 1; the cavity has an opening provided by gap 7 between the strip edges 8.

Filter rods such as those illustrated in FIGS. 1,4,7 and 10 may be cut into shorter lengths for attachment to tabacco rods.

Figure 5:
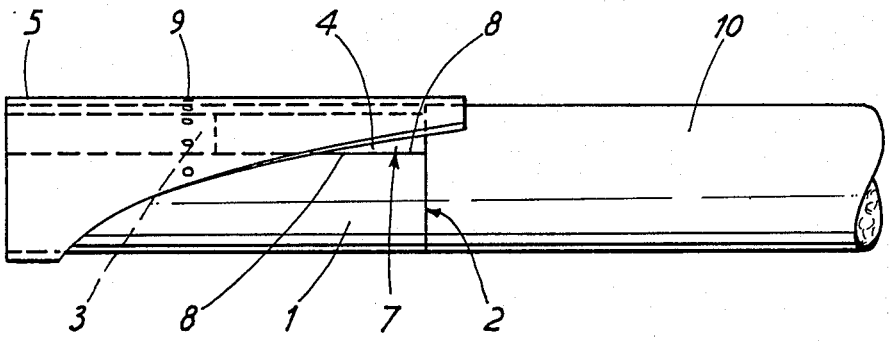
FIGS. 5,6,11 and 12 are side elevation views of filter cigarettes incorporating respective different filters according to the invention, with part of the filter outer wrap torn away.
Figure 11:
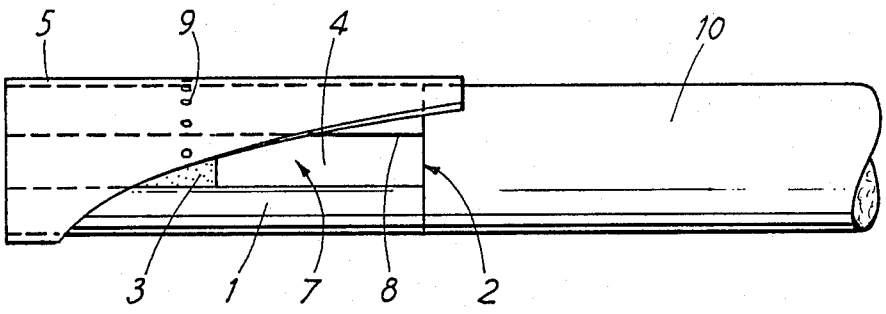

FIGS. 5 and 11 show filter cigarettes incorporating filters according to the invention the filter is a unit length cut from the composite rod of FIG. 1 (in the case of FIG. 5) of FIG. 7 (in the case of FIG. 11) fully wrapped in an outer wrap 5 which is a tipping overwrap joining the filter to a wrapped tobacco rod 10 to form the filter cigarette. The outer wrap 5 is a ventilating tipping overwrap, having a ring of perforations 9 some of which fall in register with the longitudinal gap 7 over unwrapped filter plug 3 to provide for ventilation directly into the filter core.

Figure 6:
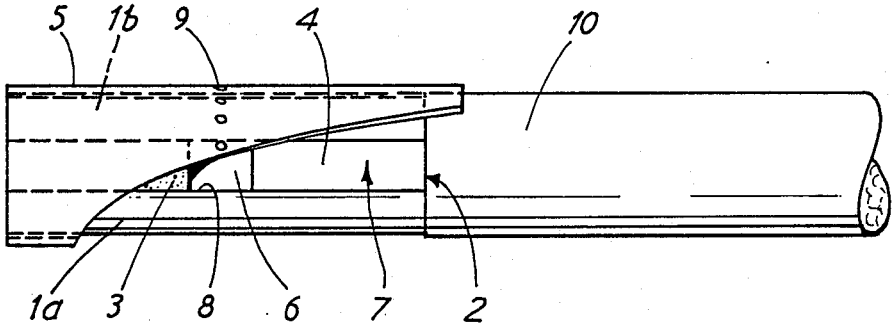
Figure 12:
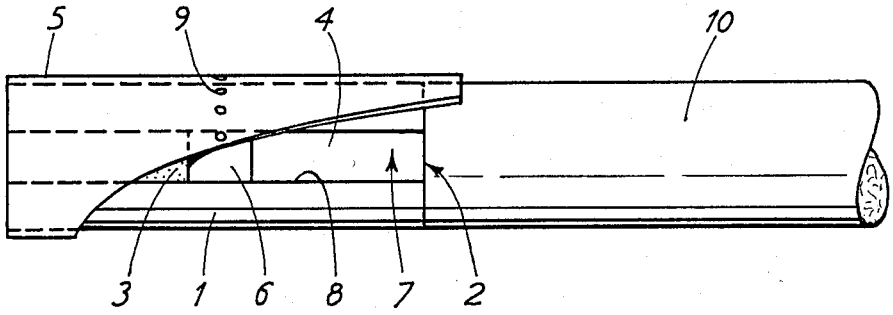

FIGS. 6 and 12 show filter cigarettes having filters according to the invention which similarly employ unit lengths cut from the composite filter rods of FIGS. 4 and 10 respectively. In these cases the ring of perforations 9 in tipping overwrap 5 is disposed so that some of the perforations 9 are in register with cavity 6 to provide for ventilation directly into this cavity.

It will be appreciated that two, three, four or more narrow strips 1*a*, 1*b* etc. of the type shown in FIG. 4 can be used instead of the single strip 1 in embodiments of the FIG. 1 type having abutting core plugs (or a longitudinally integral core), and a single strip 1 as in FIGS. 1 and 7 can be used with a longitudinally integral core. Ventilation through gaps 7, is not into a core space 6, will usually be onto a core surface which is air-permeable.

I claim:

1. A tobacco smoke filter rod of finite length having an elongate non-integral core of components joined and held in longitudinal alignment by one or more strips each extending along and only partially around the core circumference to leave at least one gap extending longitudinally the full length of the core between longitudinal strip edges and through which the core is exposed to ambient air so that ventilating air may enter the core laterally.

2. A filter rod according to claim 1 having such strips in the form of circumferentially spaced threads, strings or fine rods.

3. A filter rod according to claim 1 wherein adjacent core components differ.

4. A filter rod according to claim 1 wherein adjacent core components are spaced apart.

5. A filter comprising a filter rod according to claim 1 having an outer wrap which engages fully around the core and the one or more strips and provides for lateral ingress of external ventilating air therethrough and through said longitudinal gap.

6. A filter according to claim 5 wherein longitudinally adjacent core components are spaced apart and the outer wrap has ventilating perforations in register with the space between adjacent core components.

7. A filter according to claim 5 wherein the outer wrap is a tipping overwrap incorporating the filter in a filter cigarette.

8. A tobacco smoke filter having a non-integral core of components joined and held in longitudinal alignment by plugwrap which extends only partially around the core circumference to leave a gap extending longitudinally the full length of the core between the longitudinal edges of the plugwrap, and an outer wrap which engages fully around the core and plugwrap and provides for the lateral ingress of external ventilating air therethrough and through the longitudinal gap.

9. A tobacco smoke filter rod of finite length having a non-integral core of components joined and held in longitudinal alignment by plugwrap which extends only partially around the core circumference to leave a gap which extends longitudinally the full length of the core between the longitudinal edges of the plugwrap and through which the core is exposed to ambient air so that ventilating air may enter the core laterally.

* * * * *